US009291338B2

(12) United States Patent
Liu

(10) Patent No.: US 9,291,338 B2
(45) Date of Patent: Mar. 22, 2016

(54) MODULAR TRACK ASSEMBLY FOR SLIDABLY MOUNTING A TRACK LIGHT

(71) Applicant: DIODE-ON OPTOELECTRONICS LIMITED, Taichung (TW)

(72) Inventor: Ivan Liu, Taichung (TW)

(73) Assignee: DIODE-ON OPTOELECTRONICS LIMITED, Taichung (TW)

( * ) Notice: Subject to any disclaimer, the term of this patent is extended or adjusted under 35 U.S.C. 154(b) by 0 days.

(21) Appl. No.: 14/102,044

(22) Filed: Dec. 10, 2013

(65) Prior Publication Data

US 2015/0159840 A1 Jun. 11, 2015

(51) Int. Cl.
*H01R 33/00* (2006.01)
*F21V 21/35* (2006.01)

(52) U.S. Cl.
CPC ..... *F21V 21/35* (2013.01)

(58) Field of Classification Search
CPC ..... F21S 2/005; F21S 8/038; F21S 8/066; F21V 12/34; F21V 15/015; F21V 19/0035; F21V 21/005; F21V 21/008; F21V 21/35; F21V 23/06; H01R 25/142
USPC ..... 362/648; 439/110
See application file for complete search history.

(56) References Cited

U.S. PATENT DOCUMENTS 4,655,520 A * 4/1987 Cummings ..... 439/111
5,151,038 A * 9/1992 Range et al. ..... 439/122
5,336,100 A * 8/1994 Gabrius et al. ..... 439/115
5,803,755 A * 9/1998 Kuchar et al. ..... 439/110
6,170,967 B1 * 1/2001 Usher et al. ..... 362/394
6,244,733 B1 * 6/2001 Fong et al. ..... 362/391
7,322,735 B1 * 1/2008 Caldani et al. ..... 362/648
7,726,869 B2 * 6/2010 Chien ..... 362/648
2003/0223234 A1 * 12/2003 Tang ..... 362/226
2004/0005798 A1 * 1/2004 Lin ..... 439/110
2005/0237769 A1 * 10/2005 Hong ..... 362/648
2006/0039168 A1 * 2/2006 Mier-Langner et al. ..... 362/648
2007/0115694 A1 * 5/2007 Mobarak et al. ..... 362/648
2007/0153551 A1 * 7/2007 Chiu ..... 362/648
2007/0167043 A1 * 7/2007 Lehman et al. ..... 439/115
2009/0109707 A1 * 4/2009 Bartlett et al. ..... 362/648
2009/0284988 A1 * 11/2009 Snagel et al. ..... 362/648
2010/0087076 A1 * 4/2010 Larsson ..... 439/110
2010/0151711 A1 * 6/2010 Bianchi ..... 439/121
2010/0271834 A1 * 10/2010 Muessli ..... 362/398
2012/0002415 A1 * 1/2012 Nelson et al. ..... 362/235
2013/0044469 A1 * 2/2013 Crimi et al. ..... 362/217.11
2013/0170194 A1 * 7/2013 Osada ..... 362/217.17
2013/0182422 A1 * 7/2013 Guilmette ..... 362/184
2015/0029705 A1 * 1/2015 Kim ..... 362/147

* cited by examiner

*Primary Examiner* — Anh Mai
*Assistant Examiner* — Matthew Peerce
(74) *Attorney, Agent, or Firm* — Faegre Baker Daniels LLP

(57) ABSTRACT

A modular track assembly for a track light includes a track unit and a connector. The track unit includes a track, a circuit board, a pair of conductive elements, and a cap formed with two holes. The connector includes two conductive members, each of which includes two insertion segments. One of the insertion segments is inserted into a respective one of the holes and is connected electrically to a respective one of the conductive elements, and the other one of the insertion segments is configured to be inserted into a respective one of the holes of another modular track assembly to connect electrically to a respective one of the conductive elements of the another modular track assembly.

12 Claims, 4 Drawing Sheets

MODULAR TRACK ASSEMBLY FOR SLIDABLY MOUNTING A TRACK LIGHT

CROSS-REFERENCE TO RELATED APPLICATION

This application is related to Taiwan Application No. 102203499, filed Feb. 23, 2013, the entire disclosure of which is hereby expressly incorporated herein by reference, the priority of which is not claimed herein.

BACKGROUND OF THE INVENTION

1. Field of the Invention

This invention relates to a track light device, more particularly to a modular track assembly for slidably mounting a track light.

2. Description of the Related Art

In general, a display cabinet is equipped with a light source, e.g., a track light for illuminating objects, e.g., jewelry or antiques, and for improving their aesthetic appeal.

Taiwanese Utility Model Patent No. M289833 discloses a track light device that includes a conventional track assembly and a lamp coupled slidably to the conventional track assembly. However, the conventional track assembly usually has a fixed size. Thus, a conventional track assembly with a specific size may not be available for fitting the display cabinet that is used to display the objects.

SUMMARY OF THE INVENTION

Therefore, the object of the present invention is to provide a modular track assembly for slidably mounting a track light that can overcome the aforesaid drawback of the prior art.

According to this invention, there is provided a modular track assembly for slidably mounting a tracklight. The modular track assembly comprises a track unit and a connector. The track unit includes a track configured for slidably mounting the track light and having two opposite distal ends, a circuit board disposed at the track and having two opposite side portions adjacent respectively to the distal ends of the track, a pair of conductive elements disposed at one of the side portions, and a cap disposed at one of the distal ends which is adjacent to the one of the side portions provided with the conductive elements. The cap is formed with two holes that allow access to the conductive elements, respectively. The connector is connected removably to the cap, includes two conductive members, and is configured to interconnect the track unit of the modular track assembly and the track unit of another modular track assembly. Each of the conductive members includes two opposite insertion segments, one of which is inserted into a respective one of the holes of the cap to connect electrically to a respective one of the conductive elements, and the other one of which is configured to be inserted into a respective one of the holes of the cap of the another modular track assembly to connect electrically to a respective one of the conductive elements of the another modular track assembly.

BRIEF DESCRIPTION OF THE DRAWINGS

Other features and advantages of the present invention will become apparent in the following detailed description of the preferred embodiment of the invention, with reference to the accompanying drawings, in which.

DETAILED DESCRIPTION OF THE PREFERRED EMBODIMENT

Figure 1:
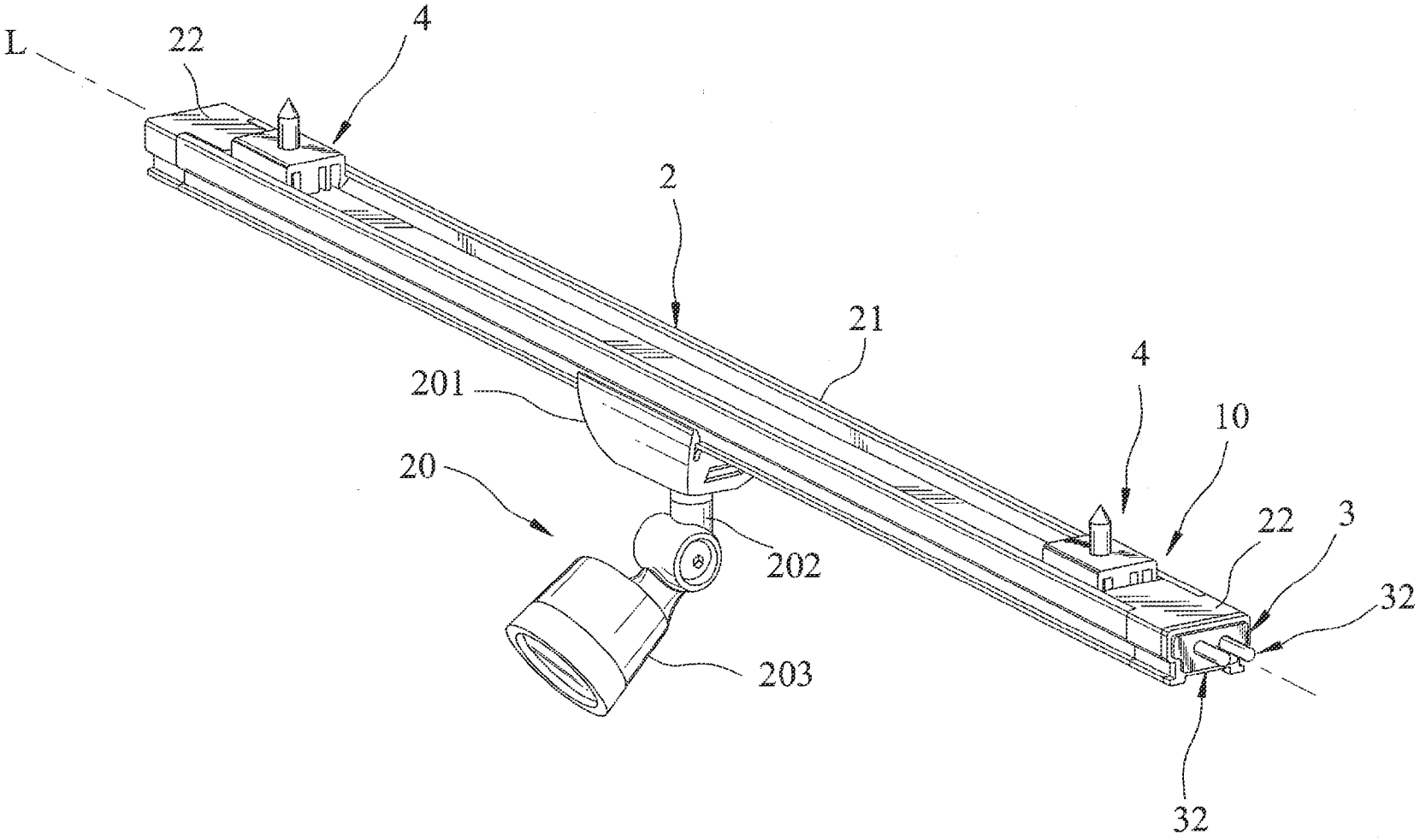
FIG. 1 is a perspective view showing the preferred embodiment of a modular track assembly for slidably mounting a track light according to this invention.
Figure 2:
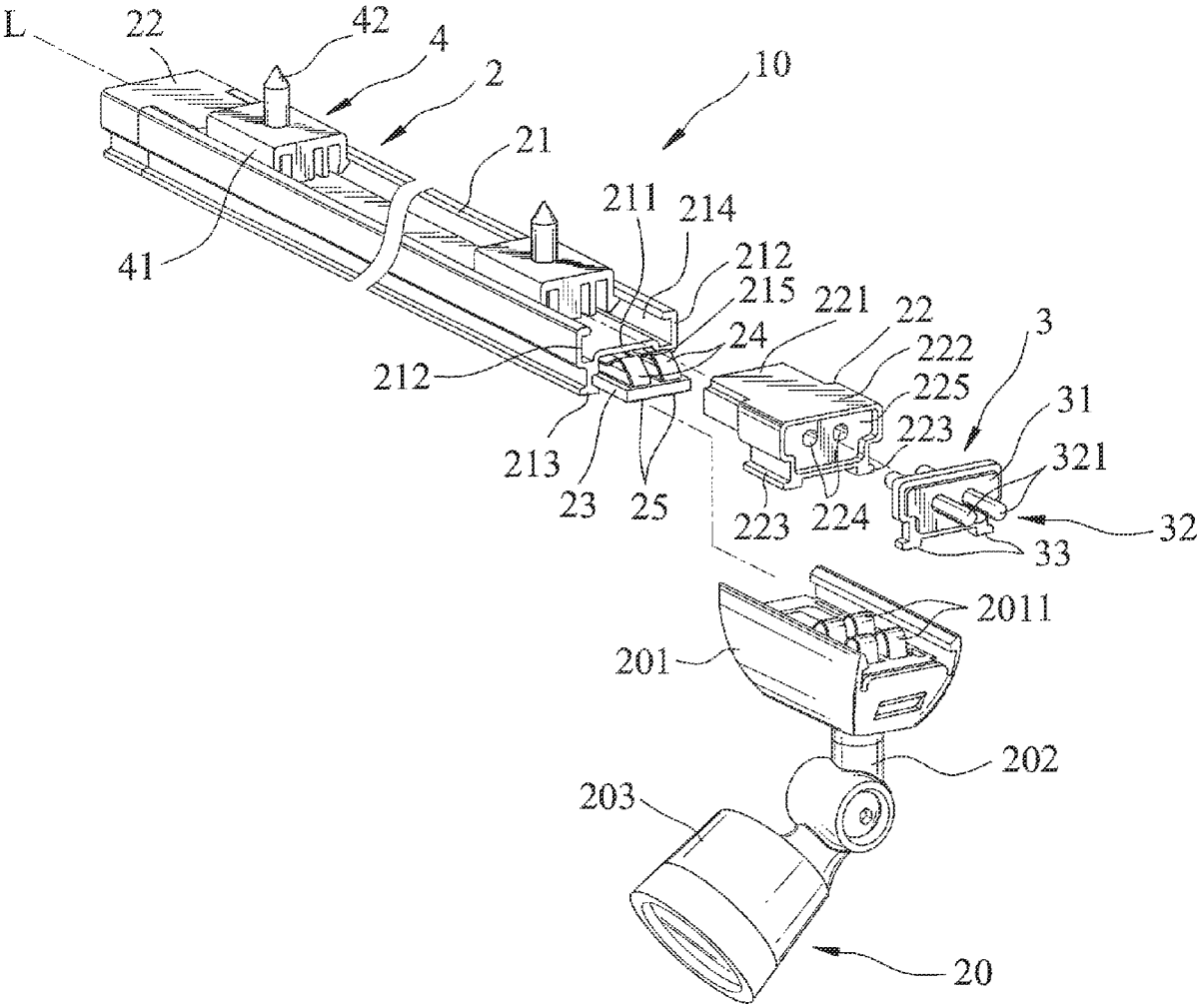
FIG. 2 is a fragmentary exploded perspective view showing the preferred embodiment of the modular track assembly.
Figure 3:
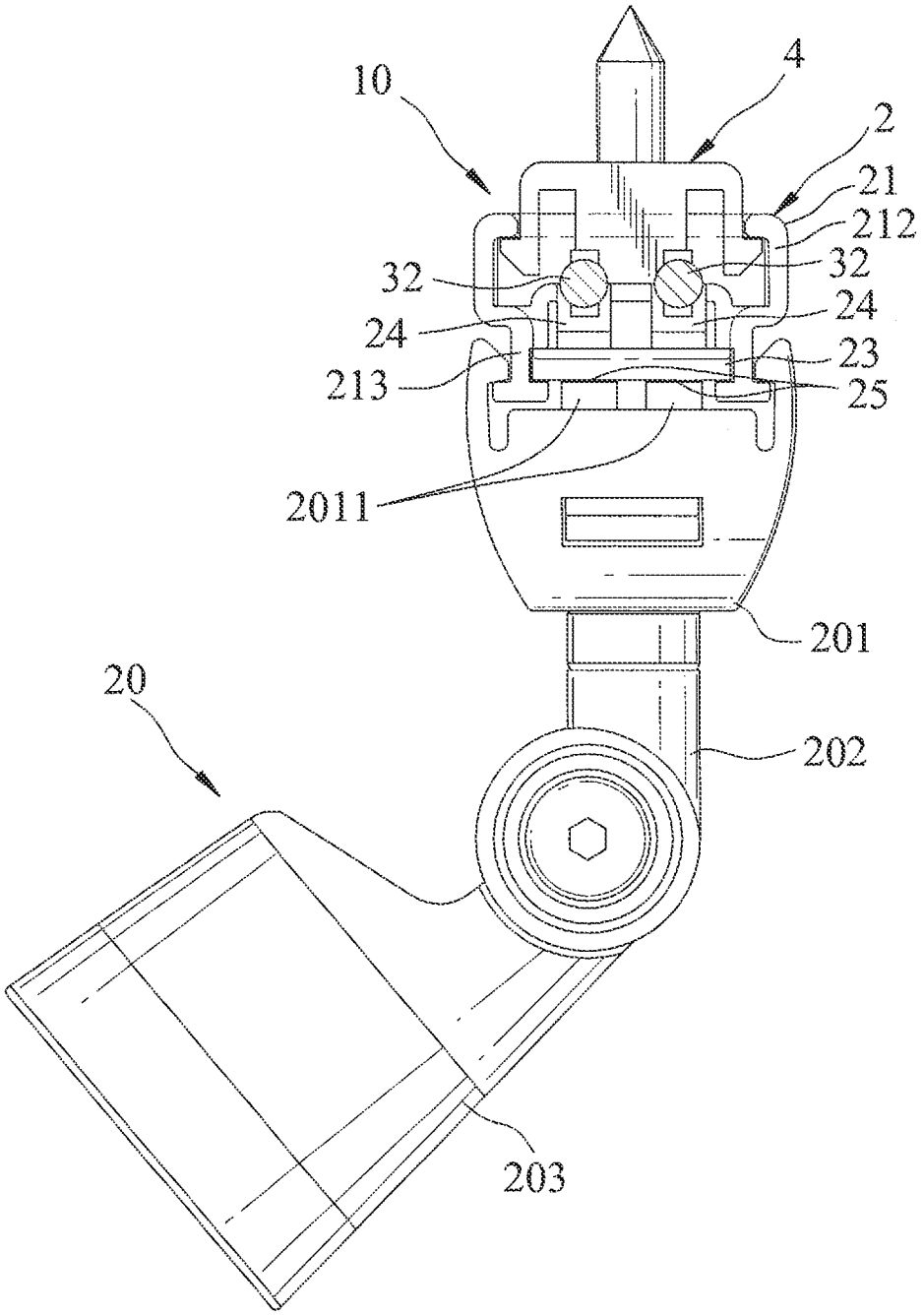
FIG. 3 is a partly cross-sectional view showing the preferred embodiment of the modular track assembly.

Referring to FIGS. 1, 2 and 3, a preferred embodiment of a modular track assembly 10 is for slidably mounting a track light 20. The modular track assembly 10 according to this invention includes a track unit 2, a connector 3, and two mounting members 4.

The track light 20 includes an engaging member 201 engaging slidably the track unit 2 of the modular track assembly 10, a rotatable shaft 202 connected rotatably to the engaging member 201, and a lamp seat 203 connected pivotally to the rotatable shaft 202. The engaging member 201 has two pairs of contacting electrodes 2011.

The track unit 2 includes a track 21 extending along a direction (L), a circuit board 23 disposed at the track 21, two pairs of conductive elements 24 (only one pair is visible due to the viewing angle), two caps 22, and a pair of fixed electrodes 25 disposed at the circuit board 23. The track 21 has two opposite distal ends, and is slidably mounted with the track light 20. The circuit board 23 has two opposite side portions respectively adjacent to the distal ends of the track 21. The two pairs of the conductive elements 24 are disposed respectively at the side portions of the circuit board 23. The caps 22 are disposed respectively at the distal ends of the track 21. Each of the caps 22 is formed with two holes 224 that allow access to a corresponding one of the two pairs of the conductive elements 24. The fixed electrodes 25 extend along the track 21, are connected electrically and respectively to the conductive elements 24 of each pair through the circuit board 23, and are in electrical and slidable contact respectively with the contacting electrodes 2011 of each pair so as to electrically interconnect the circuit board 23 and the track light 20. The conductive elements 24 are made of a metal material. In this preferred embodiment, the conductive elements 24 are leaf springs and are made of copper. Since the caps 22 are identical to each other in structure and the two pairs of the conductive elements 24 are also identical to each other in structure, for the sake of brevity, only one cap 22 and one pair of the conductive elements 24 will be described in the following description.

The track 21 includes an elongated plate 211, two extending walls 212, and two engaging walls 213. The elongated plate 211 extends along the direction (L), and has two opposite longitudinal sides. The extending walls 212 extend perpendicularly and respectively from the longitudinal sides of the elongated plate 211 in a first direction, and cooperate with the elongated plate 211 to define a receiving space 214 with two openings disposed respectively at the distal ends of the track 21. The engaging walls 213 extend respectively from the longitudinal sides of the elongated plate 211 in a second direction opposite to the first direction, allow slidable engagement with the engaging member 201 of the track light 20, and cooperate with the elongated plate 211 to define an accommodating space 215. In this embodiment, the circuit board 23 is disposed in the accommodating space 215. In this preferred embodiment, the track 21 is formed integrally by aluminum extrusion and thus, has a relatively light weight.

The cap 22 includes an insertion portion 221, a cap main body 222 connected to the insertion portion 221, and two cap extension portions 223 that extend from the cap main body 222 in the second direction. The insertion portion 221 is inserted into the receiving space 214 through a corresponding one of the openings. The cap main body 222 covers the corresponding one of the openings, and is formed with the holes 224 and a cavity 225 in spatial communication with the holes 224. The cap extension portions 223 are respectively flush with the engaging walls 213 of the track 21 so as to allow slidable engagement with the engaging member 201 of the track light 20. In this embodiment, the cap 22 is made of electrical insulating material.

The connector 3 is connected removably to one of the caps 22, is configured to interconnect the track unit 2 of the modular track assembly 10 and the track unit 2 of another modular track assembly 10 (see FIG. 4), and includes a connector main body 31, two conductive members 32, and two connector extension portions 33. The connector main body 31 is partly received in the cavity 225 of the cap 22. Each of the conductive members 32 includes two opposite insertion segments 321, one of which is inserted into a respective one of the holes 224 of the cap 22 to connect electrically to a respective one of the conductive elements 24, and the other one of which is configured to be inserted into a respective one of the holes 224 of the cap 22 of the another modular track assembly 10 to connect electrically to a respective one of the conductive elements 24 of the another modular track assembly 10. Each of the conductive members 32 extends through the connector main body 31, and the insertion segments 321 of each of the conductive members 32 are opposite to each other with respect to the connector main body 31. The connector extension portions 33 extend from the connector main body 31 in the second direction and are respectively flush with the cap extension portions 223 so as to allow slidable engagement with the engaging member 201 of the track light 20. In this embodiment, the connector main body 31 is made of electrical insulating material. The conductive members 32 are preferably configured as cylinders and are made of metal material. In this preferred embodiment, the conductive members 32 are made of copper.

The mounting members 4 are disposed at the track 21 of the track unit 2 for mounting of the modular track assembly 10, and each of the mounting members 4 includes an engagement block 41 engaging removably between the extending walls 212, and a pin 42 connected to the engagement block 41 and configured to be inserted into an object (for example, but not limited to, an inner surface of a display cabinet, a wall, a floor, etc.). It is noted that the number of the mounting members 4 is not limited to two, and may vary according to different requirements.

Figure 4:
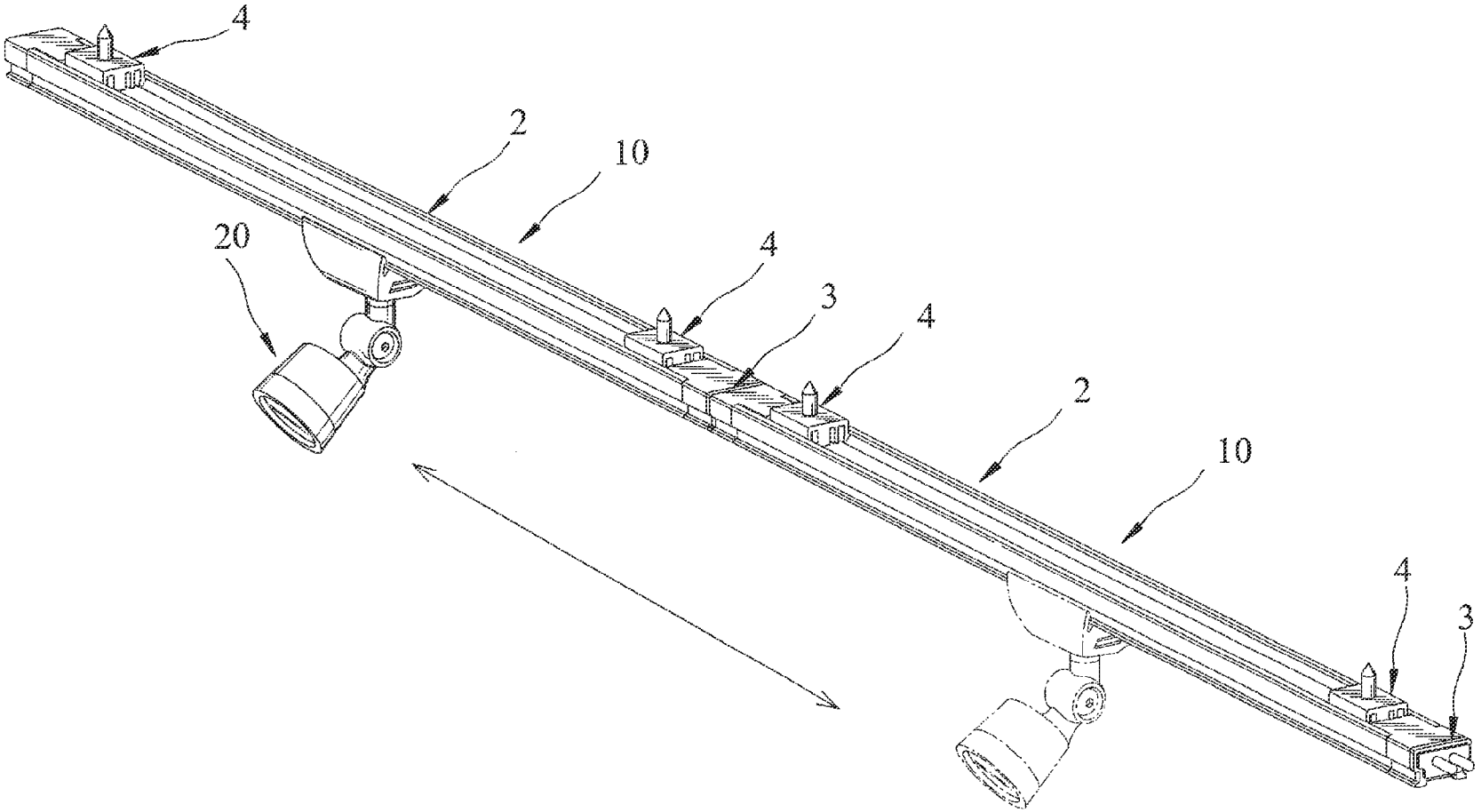
FIG. 4 is a perspective view showing connection of two of the modular track assemblies according to the preferred embodiment.

FIG. 4 shows two of the track units 21 of the modular track assemblies 10 are connected to each other via the connector 3 of one of the modular track assemblies 10. More than two of the track units 21 may be connected in series according to requirements.

It should be noted that the engaging member 201 has two pairs of the contacting electrodes 2011 to ensure that at least one of the pairs of the contacting electrodes 2011 is able to electrically and respectively contact the fixed electrodes 25 of one of the track units 2 when the engaging member 201 slides between two adjacent modular track assemblies 10, so that the track light 20 can be constantly electrically connected to the circuit board 23 when sliding on the modular track assemblies 10.

To sum up, a plurality of the track units 21 can be connected together via one or more of the connectors 3 such that the modular track assembly 10 is convenient to assemble and to apply to different display cabinets with different sizes.

While the present invention has been described in connection with what is considered the most practical and preferred embodiment, it is understood that this invention is not limited to the disclosed embodiment but is intended to cover various arrangements included within the spirit and scope of the broadest interpretations and equivalent arrangements.

What is claimed is:

1. A modular track assembly for slidably mounting a track light, said modular track assembly comprising:

a track unit including a track configured for slidably mounting the track light and having two opposite distal ends, a circuit board disposed at said track, and having two opposite side portions adjacent to said distal ends of said track, respectively, a pair of conductive elements disposed at one of said side portions of said circuit board, and a cap disposed at one of said distal ends which is adjacent to said one of said side portions provided with said conductive elements, and being formed with two holes that allow access to said conductive elements, respectively; and a connector connected removably to said cap, including two conductive members, and configured to interconnect said track unit of said modular track assembly and said track unit of another modular track assembly, each of said conductive members including two opposite insertion segments, one of said insertion segments being inserted into a respective one of said holes of said cap to connect electrically to a respective one of said conductive elements, the other one of said insertion segments being configured to be inserted into a respective one of said holes of said cap of said another modular track assembly to connect electrically to a respective one of said conductive elements of said another modular track assembly, wherein said track includes an elongated plate having two opposite longitudinal sides, two extending walls extending perpendicularly and respectively from said longitudinal sides of said elongated plate in a first direction and cooperating with said elongated plate to define a receiving space with two openings disposed respectively at said distal ends of said track, and two engaging walls extending respectively from said longitudinal sides of said elongated plate in a second direction opposite to the first direction, allowing slidable engagement with the track light, and cooperating with said elongated plate to define an accommodating space, and wherein said circuit board is disposed in said accommodating space, and said cap includes an insertion portion inserted into said receiving space through a corresponding one of said openings.

2. The modular track assembly as claimed in claim 1, wherein said circuit board of said track unit further includes another pair of said conductive elements disposed at the other one of said side portions, and said track unit further includes another cap that is identical to said cap in structure, that is disposed at the other one of said distal ends, and that is configured to be connected removably to said connector of yet another modular track assembly.

3. The modular track assembly as claimed in claim 1, wherein said connector further includes a connector main body, said conductive members extend through said connector main body, and said insertion segments of each of said conductive members are opposite to each other with respect to said connector main body.

4. The modular track assembly as claimed in claim 1, wherein said cap further includes:

a cap main body that is connected to said insertion portion, that covers said corresponding one of said openings, and that is formed with said holes; and two cap extension portions that extend from said cap main body in the second direction, and that are flush with said engaging walls of said track, respectively, so as to allow slidable engagement with the track light.

5. The modular track assembly as claimed in claim 4, wherein said connector further includes a connector main body, and two connector extension portions extending from said connector main body in the second direction and being flush with said cap extension portions, respectively, so as to allow slidable engagement with the track light, and wherein said conductive members extend through said connector main body, and said insertion segments of each of said conductive members are opposite to each other with respect to said connector main body.

6. The modular track assembly as claimed in claim 4, wherein said connector further includes a connector main body, said conductive members extend through said connector main body, and said insertion segments of each of said conductive members are opposite to each other with respect to said connector main body, and wherein said cap is further formed with a cavity in spatial communication with said holes for partly receiving said connector main body.

7. The modular track assembly as claimed in claim 1, further comprising at least one mounting member disposed at said track of said track unit for mounting of said modular track assembly.

8. The modular track assembly as claimed in claim 7, wherein said mounting member includes an engagement block engaging removably between said extending walls, and a pin connected to said engagement block and configured to be inserted into an object.

9. The modular track assembly as claimed in claim 1, wherein said track unit further includes a pair of fixed electrodes connected electrically and respectively to said conductive elements through said circuit board and configured for electrically interconnecting said circuit board and the track light.

10. The modular track assembly as claimed in claim 9, wherein said fixed electrodes extend along said track.

11. The modular track assembly as claimed in claim 1, wherein said conductive elements and said conductive members are made of a metal material.

12. The modular track assembly as claimed in claim 1, wherein each of said conductive elements is a leaf spring.

* * * * *